US010483640B1

(12) United States Patent
Issa et al.

(10) Patent No.: US 10,483,640 B1
(45) Date of Patent: Nov. 19, 2019

(54) OMNIDIRECTIONAL ULTRA-WIDEBAND ANTENNA

(71) Applicant: KING SAUD UNIVERSITY, Riyadh (SA)

(72) Inventors: Khaled Issa, Riyadh (SA); Muhammad Ahmed Ashraf, Riyadh (SA); Waleed Tariq Sethi, Riyadh (SA); Habib Fathallah, Soukra (TN); Saleh Alshebeili, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/237,620

(22) Filed: Dec. 31, 2018

(51) Int. Cl.
*H01Q 1/36* (2006.01)
*H01Q 5/25* (2015.01)
*H01Q 1/48* (2006.01)

(52) U.S. Cl.
CPC ..... *H01Q 5/25* (2015.01); *H01Q 1/36* (2013.01); *H01Q 1/48* (2013.01)

(58) Field of Classification Search
CPC ..... H01Q 1/36; H01Q 5/25; H01Q 13/04
USPC ..... 343/773–776
See application file for complete search history.

(56) References Cited

U.S. PATENT DOCUMENTS 3,401,387 A 9/1968 Milligan et al.
6,195,061 B1 2/2001 Hizal et al.
6,268,834 B1 7/2001 Josypenko
7,006,047 B2 2/2006 Marsan et al.
7,701,396 B2 4/2010 Cohen
D623,633 S 9/2010 Bliss et al.
7,973,732 B2 7/2011 Cohen
D713,392 S 9/2014 Podduturi
2006/0250315 A1 11/2006 Parsche
2010/0085264 A1* 4/2010 Du ..... H01Q 9/40 343/772
2010/0194646 A1 8/2010 Cohen
2012/0068903 A1 3/2012 Thevenard et al.
2014/0203984 A1* 7/2014 Nilsson ..... H01Q 1/42 343/774
2015/0255874 A1* 9/2015 Hung ..... H01Q 9/40 343/786
2015/0280317 A1* 10/2015 Morin ..... H01Q 9/28 343/795
2017/0025750 A1* 1/2017 Su ..... H01Q 1/36

* cited by examiner

*Primary Examiner* — Dameon E Levi
*Assistant Examiner* — Hasan Z Islam
(74) *Attorney, Agent, or Firm* — Richard C. Litman; Nath, Goldberg & Meyer

(57) ABSTRACT

The omnidirectional ultra-wideband antenna is a variant on a monocone antenna, particularly including a supplemental radiating element. The omnidirectional ultra-wideband antenna includes an electrically conductive conical surface having a vertex end and a base end, and a supplemental radiating element having a first portion and a second portion. The first portion extends from the base end of the electrically conductive conical surface, the first portion being positioned between the base end of the electrically conductive conical surface and the second portion. The vertex end of the electrically conductive conical surface is positioned adjacent to, and spaced apart from, a first surface of a ground plane plate. At least one electrically conductive rod is provided, a first end of the rod being secured to the second portion, and a second end of each rod being mounted on the first surface of the ground plane plate.

8 Claims, 9 Drawing Sheets

OMNIDIRECTIONAL ULTRA-WIDEBAND ANTENNA

BACKGROUND

1. Field

The disclosure of the present patent application relates to multiband antennas, and particularly to an omnidirectional ultra-wideband antenna that is a compact antenna for frequencies from TETRA (Terrestrial Trunked Radio)-bands to the new 5G bands.

2. Description of the Related Art

FIG. 3 shows a conventional prior art monocone antenna 100, which is formed from a conical surface 114, defined by a vertex end 116 and a base end 118, and a cylindrical surface 112 extending from the base end 118. The cylindrical surface 112 extends the length of the conical surface 114 for the purpose of lowering its low frequency cutoff. Vertex end 116 is positioned adjacent a ground plane plate 120. The ground plane plate 120 may, e.g., be part of the skin of an aircraft to which the monocone antenna 100 is mounted. A center conductor 122 of a coaxial cable 124 is connected to the vertex end 116 to feed the antenna 100. The outer conductor 126 of the coaxial cable 124 is connected to the ground plane 120. The vertex end 116 is adjacent to, but spaced apart from, the ground plane plate 120.

The antenna pattern of the monocone antenna 100 is substantially omnidirectional on the side of the ground plane plate 120 facing the conical surface 114. The functionality of the monocone antenna 100 is limited with regard to diverse usage, since the height and the cone angle of the monocone define the low frequency cutoff, i.e., by having a fixed construction with a fixed geometry, the monocone antenna 100 has a predefined set low frequency cutoff. Thus, an omnidirectional ultra-wideband antenna solving the aforementioned problems is desired.

SUMMARY

The omnidirectional ultra-wideband antenna is a variant on a monocone antenna, particularly including a supplemental radiating element. The omnidirectional ultra-wideband antenna includes an electrically conductive conical surface, having a vertex end and a base end, and a supplemental radiating element having a first portion and a second portion. The first portion extends from the base end of the electrically conductive conical surface, such that the first portion is positioned between the base end of the electrically conductive conical surface and the second portion. The first portion is cylindrical, and the second portion is frustoconical. In an alternative embodiment, the first portion may be frustoconical, and the second portion may be cylindrical. The vertex end of the electrically conductive conical surface is positioned adjacent to, and spaced apart from, a first surface of a ground plane plate.

At least one electrically conductive rod is provided. The at least one electrically conductive rod has opposed first and second ends, the first end being secured to the second portion of the supplemental radiating element, and the second end being connected to the first surface of the ground plane plate. A center conductor of a coaxial cable is in electrical communication with the vertex end of the electrically conductive conical surface, and an outer conductor of the coaxial cable is in electrical communication with the ground plane plate.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
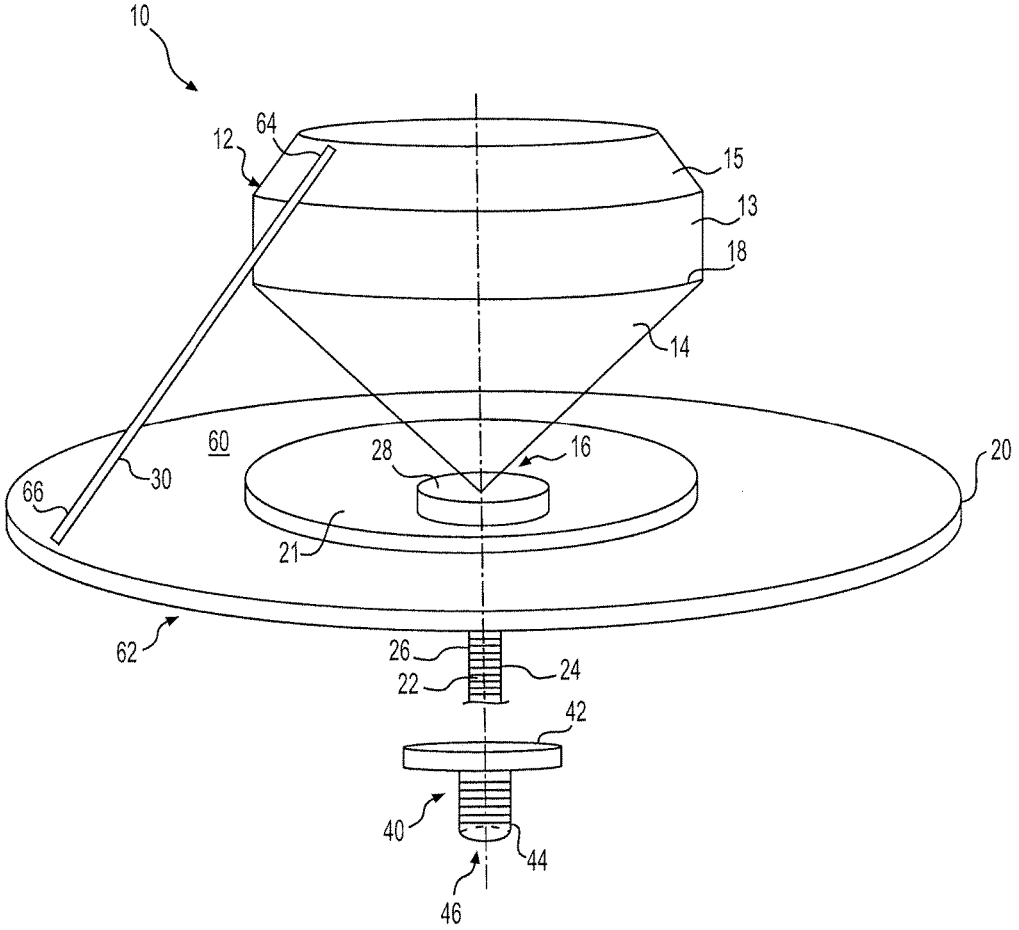
FIG. 1 is a perspective view of an omnidirectional ultra-wideband antenna.
Figure 3:
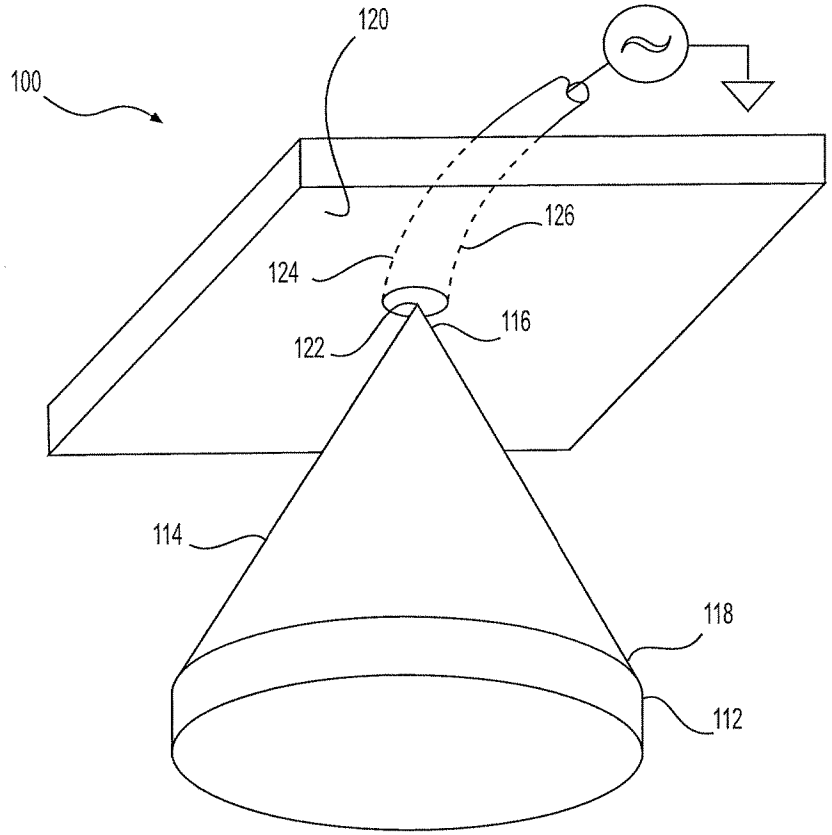
FIG. 3 (PRIOR ART)
FIG. 3 is a perspective view of a conventional prior art monocone antenna.

The omnidirectional ultra-wideband antenna 10 is a variant on a monocone antenna, such as that described above with respect to FIG. 3. The omnidirectional ultra-wideband antenna 10 includes a supplemental radiating element 12, as will be described in greater detail below. As shown in FIG. 1, the omnidirectional ultra-wideband antenna 10 includes an electrically conductive conical surface 14, having a vertex end 16 and a base end 18, and a supplemental radiating element 12 having a first portion 13 and a second portion 15. The first portion 13 is extends from the base end 18 of the electrically conductive conical surface 14, such that the first portion 13 is positioned between the base end 18 of the electrically conductive conical surface 14 and the second portion 15.

The vertex end 16 of the electrically conductive conical surface 14 is positioned adjacent to, and spaced apart from, a first surface 60 of a ground plane plate 20. As shown, an annular, electrically nonconductive spacer 28 may be positioned between the vertex end 16 of the electrically conductive conical surface 14 and the first surface 60 of the ground plane plate 20. In FIG. 1, the ground plane plate 20 is shown as being a circular plate. However, it should be understood that the circular ground plane plate 20 is shown for exemplary purposes only and may have any suitable configuration and relative dimensions. Additionally, as shown, the first surface 60 of the ground plane plate 20 may have a raised central portion 21, and the annular, electrically nonconductive spacer 28 is mounted thereon. The raised central portion 21 increases the effective length of the ground plate 20, thus reducing the overall dimensions of the ground plane plate 20.

It should be understood that the order of the cylindrical and frustoconical portions 13, 15 is not material to the properties of the antenna 10, i.e., the first portion 13 and the second portion 15 of the supplemental radiating element 12 may each be either cylindrical or frustoconical, and the supplemental radiating element 12 may have more than two such portions 13, 15. For example, in FIG. 1, the first portion 13 is cylindrical and the second portion 15 is frustoconical. However, in FIG. 2, the supplemental radiating element 12' has a first portion 13' and a second portion 15'. As shown, the first portion 13' may be frustoconical and the second portion 15' may be cylindrical. In manufacture, it should be understood that any suitable number of cylindrical elements 13' or 15' may be added, allowing the cylindrical portion to be manufactured with a desired height.

It should be understood that the electrically conductive conical surface 14, the supplemental radiating element 12, and ground plane plate 20 may be formed from any suitable type of electrically conductive material, such as copper, aluminum or brass sheet material, as is well known in the field of antenna construction. Further, it should be understood that the electrically conductive conical surface 14, the supplemental radiating element 12, and ground plane plate 20 may be enclosed by a wire cage and/or may be formed from wire mesh, as is also well known in the field of antenna construction.

Figure 2:
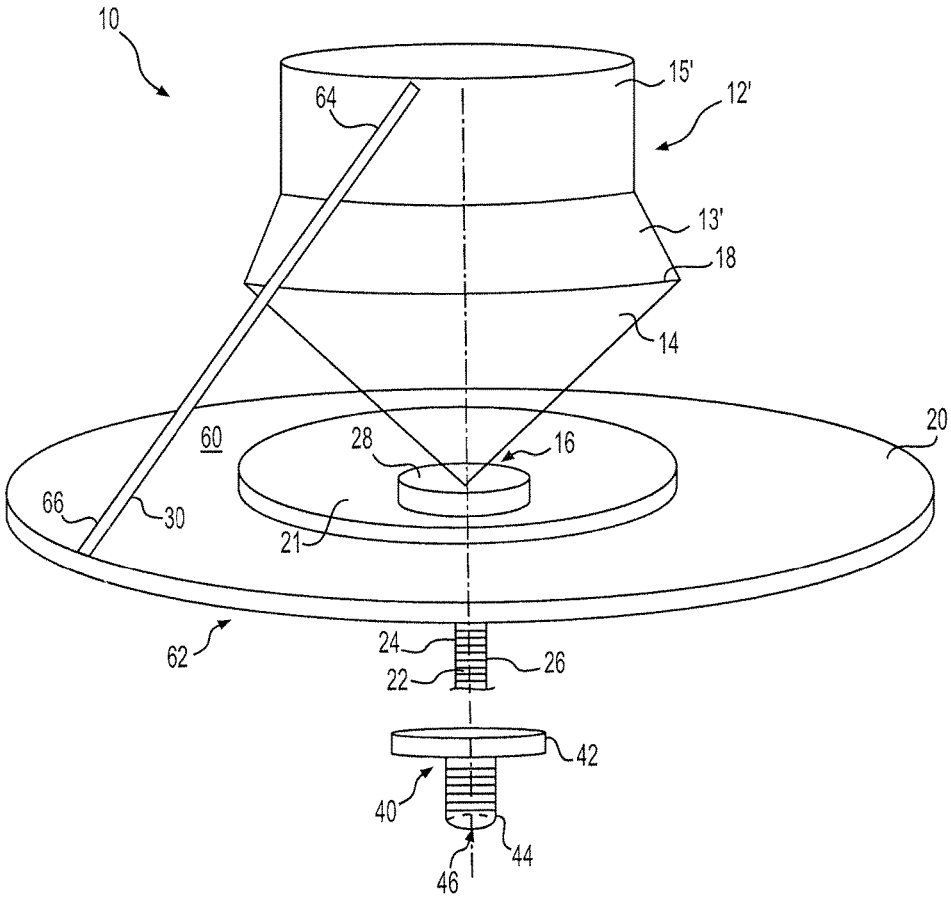
FIG. 2 is a perspective view of an alternative embodiment of the omnidirectional ultra-wideband antenna.

At least one electrically conductive rod 30 is provided, such that a first end 64 of the at least one electrically conductive rod 30 is secured to the second portion 15 of the supplemental radiating element 12 (preferably to the edge of the second portion 15), and a second end 66 of the at least one electrically conductive rod 30 is mounted on the first surface 60 of the ground plane plate 20, or preferably to the edge of the ground plane plate 20. (Only a single rod 30 is shown in the drawings; preferably, however, a single rod 30 is connected between the upper edge of each radiating element 13, 14, 15 and the edge of the ground plane plate 20.) In FIGS. 1 and 2, only a single rod 30 is shown. However, it should be understood that any suitable number of rods 30 may be used. Preferably, the number of electrically conductive rods is less than or equal to three, and in the case of multiple rods 30, they are preferably equally angularly spaced with respect to one another and with respect to the circular ground plane plate 20. As shown, the second end 66 of the at least one electrically conductive rod is preferably secured to the ground plane plate 20 adjacent a peripheral edge thereof.

A center conductor 22 of a coaxial cable 24 is in electrical communication with the vertex end 16 of the electrically conductive conical surface 14, and an outer conductor 26 of the coaxial cable 24 is in electrical communication with a lower surface 62 of the ground plane plate 20. As shown in FIGS. 1 and 2, a cable fixing member 40 may be provided in the form of a hollow tubular portion 44 with an annular flange 42. Coaxial cable 24 extends through the central passage 46 of the hollow tubular portion 44 for securing the coaxial cable 24. The annular flange 42 may contact the lower surface 62 of the ground plane plate 20 or, alternatively, the cable fixing member 40 may be used as a mounting structure, such that a mounting surface, such as the wall of an airplane or the like, is clamped between the annular flange 42 and the second surface 62.

Figure 4:
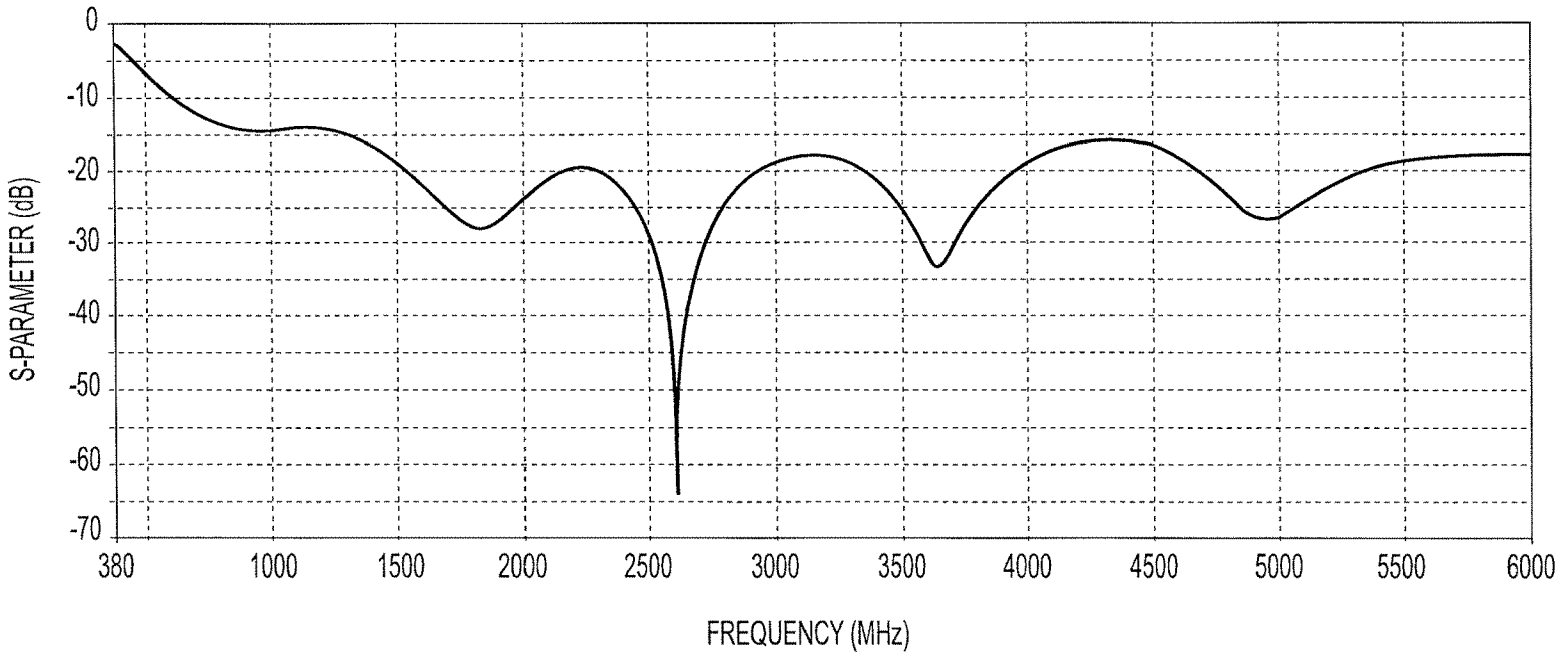
FIG. 4 is a graph showing the input return loss ($S_{11}$) of the omnidirectional ultra-wideband antenna in the 380 MHz to 6 GHz range.
Figure 5:
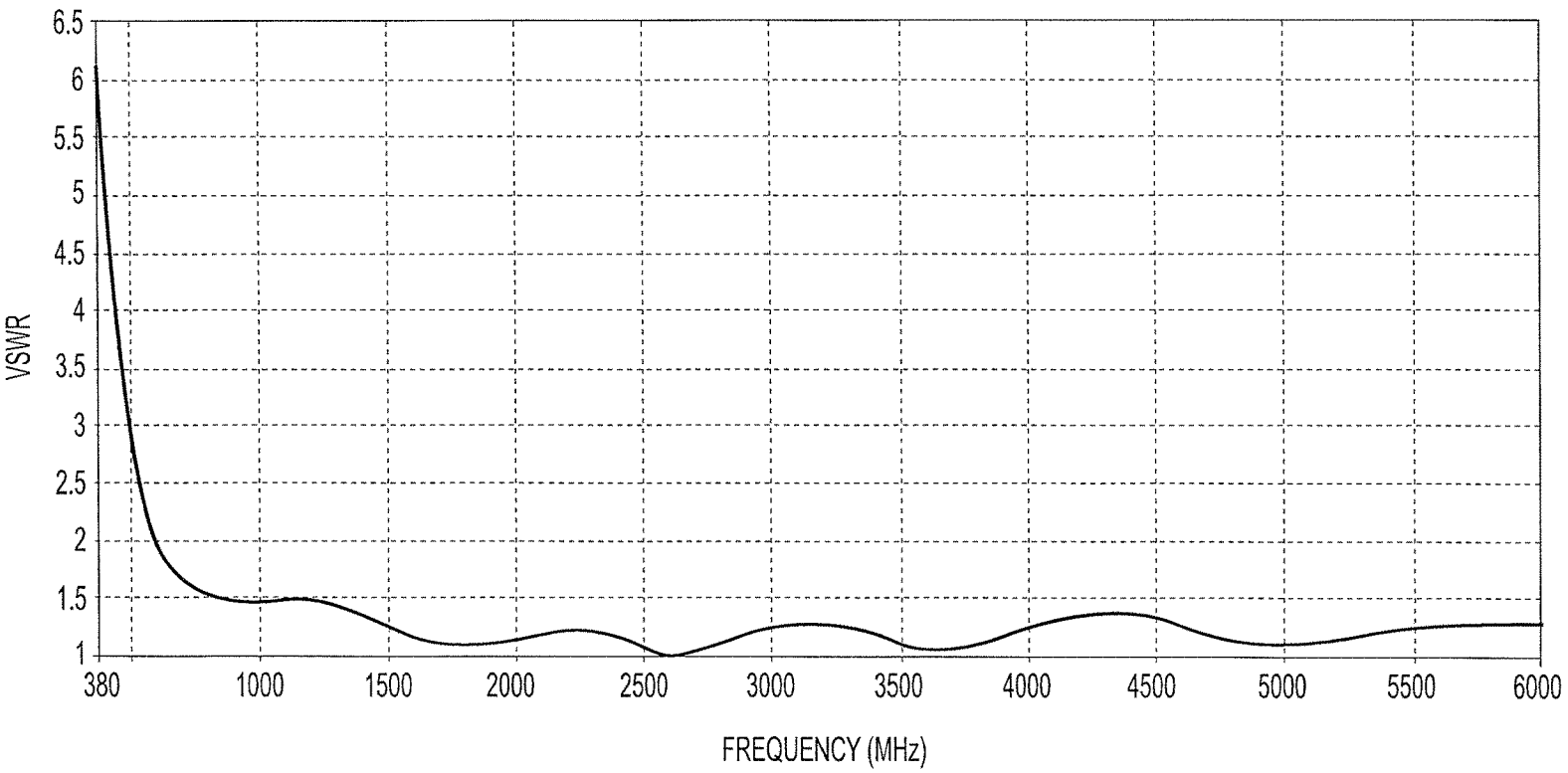
FIG. 5 is a graph showing the voltage standing wave ratio (VSWR) of the omnidirectional ultra-wideband antenna in the 380 MHz to 6 GHz range.
Figure 6:
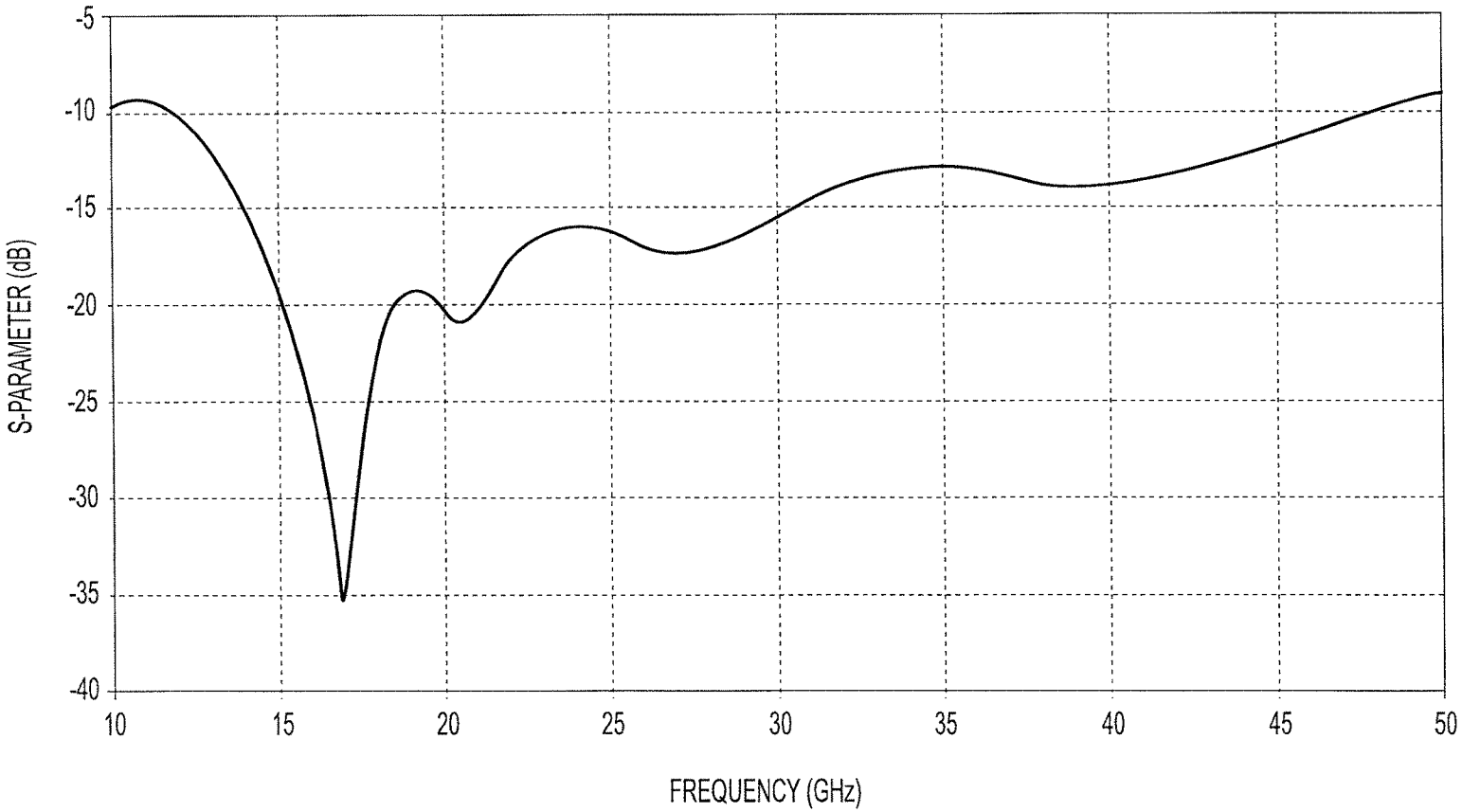
FIG. 6 is a graph showing the input return loss ($S_{11}$) of the omnidirectional ultra-wideband antenna in the 10 GHz to 50 GHz range.

FIGS. 4 and 5 show, respectively, the $S_{11}$ parameter (i.e., the return loss) and voltage standing wave ratio (VSWR) for the omnidirectional ultra-wideband antenna 10 in the 380 MHz-6 GHz band. Compared against a conventional monocone antenna, the overall dimensions of the ground plane plate 20, due to the inclusion of raised portion 21, are reduced by 12%. Compared against the conventional monocone antenna, the total height and diameters of the radiating elements are reduced by at least by 9%. As shown, the omnidirectional ultra-wideband antenna 10 yields ultra-wideband performance with a return loss less than −15 dB from 600 MHz to 9 GHz, and with a gain for the main frequency range (e.g., the frequency ranges used by GSM and Wi-Fi) is more than 9 dBi. Further, a very low VSWR can be seen, particularly a VSWR less than 1.5:1 from 600 MHz to 9 GHz. FIG. 6 shows the $S_{11}$ input return loss parameter for the omnidirectional ultra-wideband antenna 10 extended to a larger range of frequency bands, such as the millimeter wave band.

Figure 7:
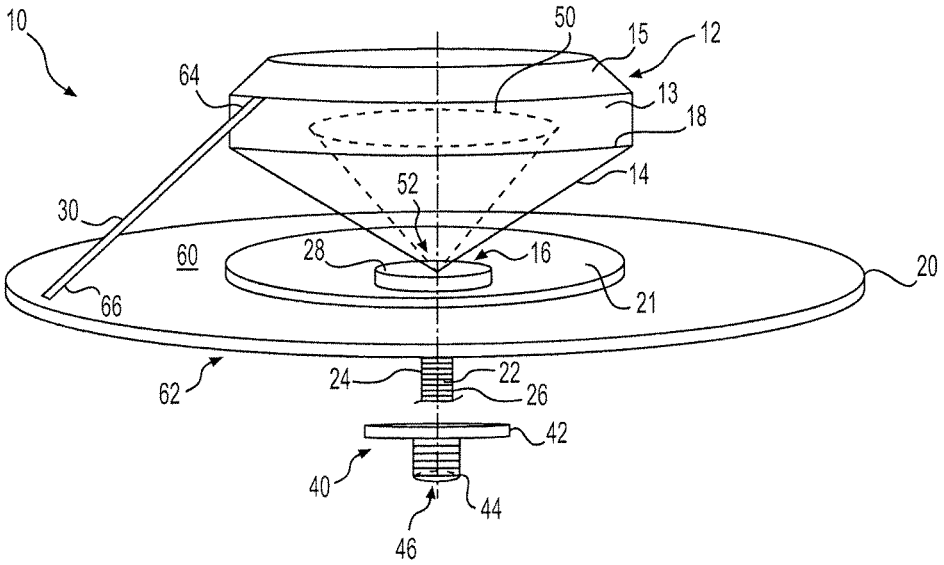
FIG. 7 is a perspective view of another alternative embodiment of the omnidirectional ultra-wideband antenna.
Figure 8:
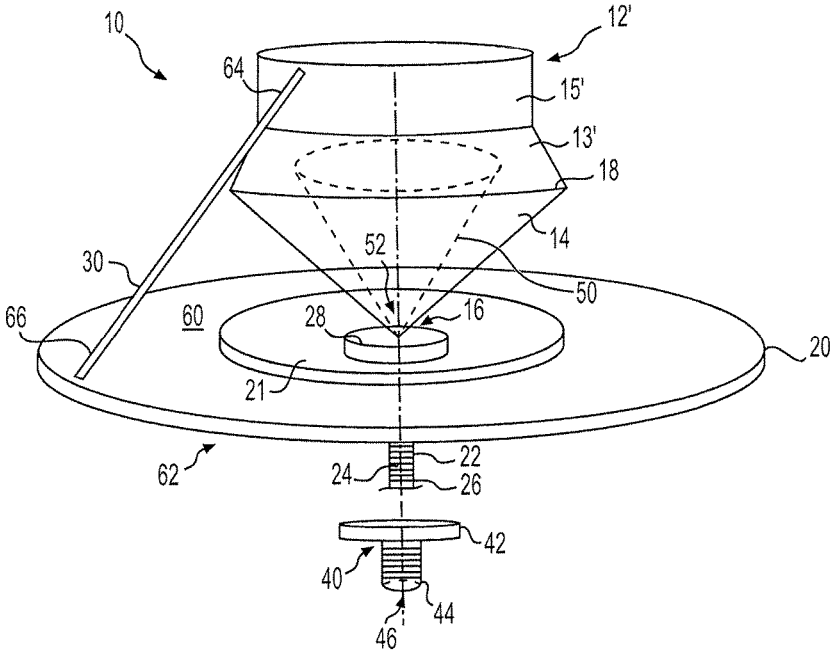
FIG. 8 is a perspective view of still another alternative embodiment of the omnidirectional ultra-wideband antenna.

As shown in FIGS. 7 and 8, a third radiating element 50 has been added to the omnidirectional ultra-wideband antenna 10 of FIGS. 1 and 2, respectively. As shown, the third radiating element 50 is mounted inside the electrically conductive conical surface 14 and may also be conical, the vertex end 52 of the third radiating element 50 being positioned adjacent the vertex end 16 of the electrically conductive conical surface 14, each of the radiating surfaces 14, 13, 15, and 50 being coaxial.

Figure 9:
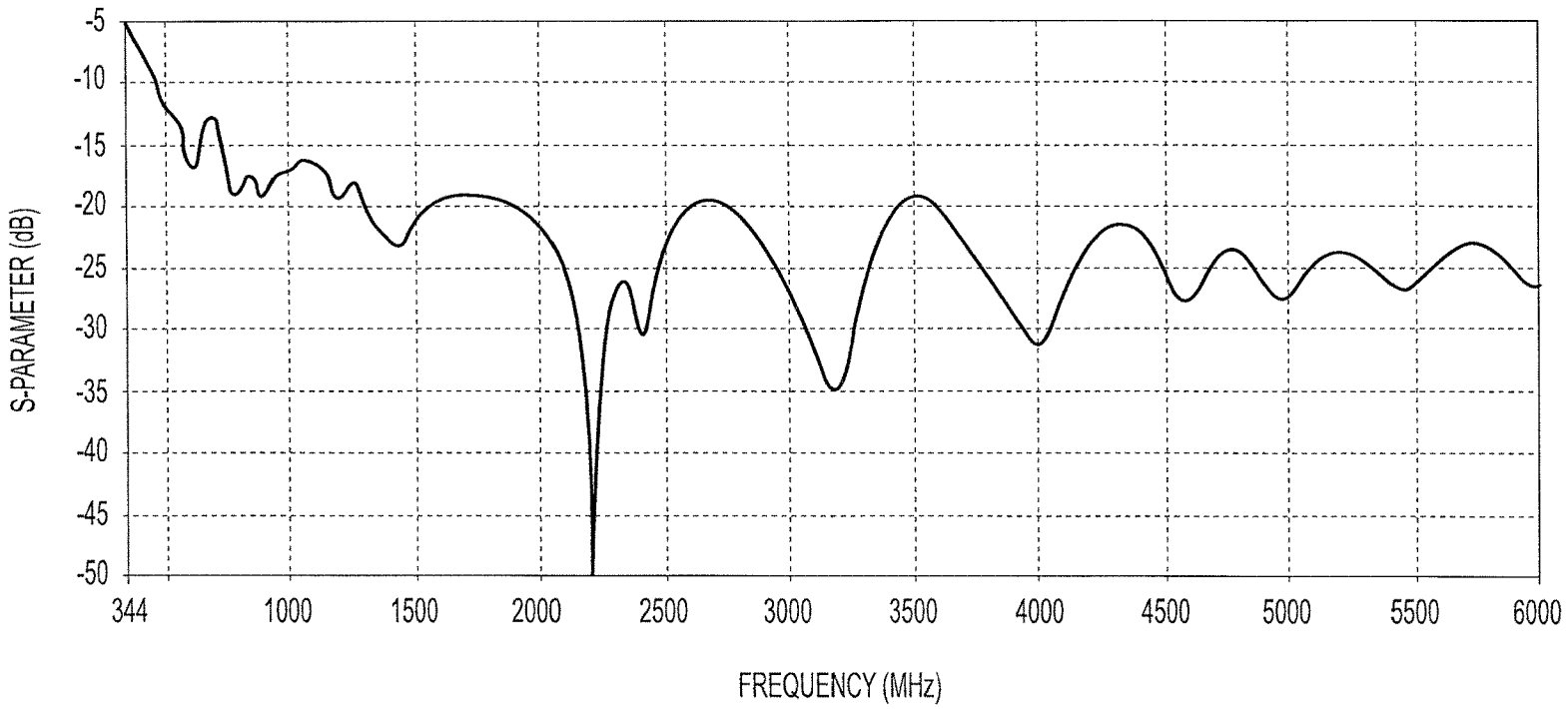
FIG. 9 is a graph showing the input return loss ($S_{11}$) of the omnidirectional ultra-wideband antenna of FIG. 7 in the 380 MHz to 6 GHz range.
Figure 10:
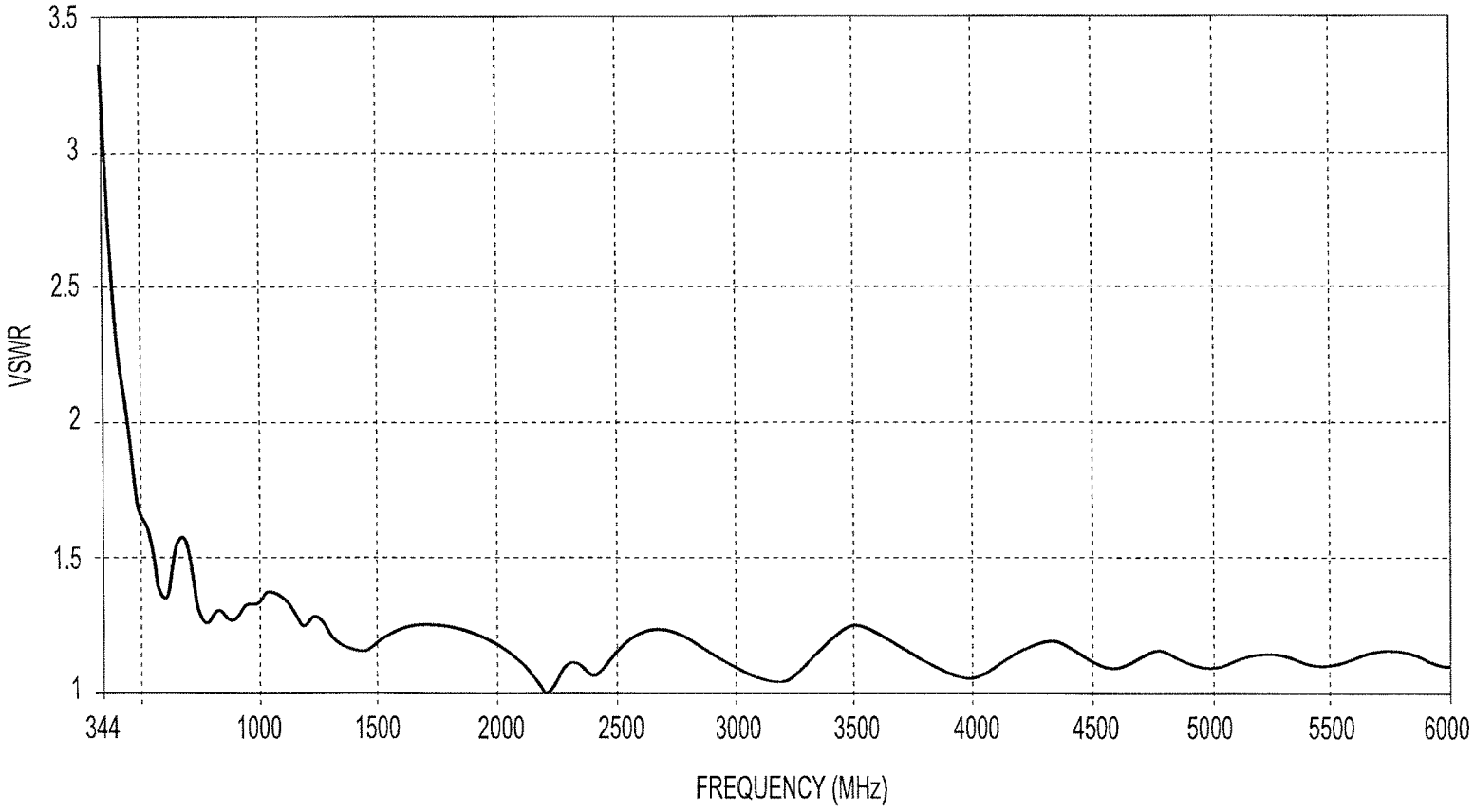
FIG. 10 is a graph showing the voltage standing wave ratio (VSWR) of the omnidirectional ultra-wideband antenna of FIG. 7 in the 380 MHz to 6 GHz range.

FIGS. 9 and 10 show, respectively, the S 11 parameter (i.e., the input port return loss) and voltage standing wave ratio (VSWR) for the omnidirectional ultra-wideband antenna 10 having the third radiating element 50, as described above, in the 380 MHz-6 GHz band. Compared against the conventional monocone antenna, the total height and diameters of the radiating elements are reduced by at least by 8%. As shown, the omnidirectional ultra-wideband antenna 10 having the additional third radiating element 50, yields ultra-wideband performance with a return loss less than −15 dB from 600 MHz to 9 GHz, and less than −17 dB from 1.1 GHz to 6 GHz, and with a gain for the main frequency range (e.g., the frequency ranges used by GSM and Wi-Fi) of more than 9.5 dBi. Further, a very low VSWR can be seen, particularly a VSWR less than 1.5:1 from 600 MHz to 9 GHz, and less than 1.3 from 1.1 GHz to 6 GHz.

It is to be understood that the omnidirectional ultra-wideband antenna is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An omnidirectional ultra-wideband antenna, comprising:

an electrically conductive conical surface having a vertex end and a base end;

a supplemental radiating element having a first portion and a second portion, the first portion extending from the base end of the electrically conductive conical surface, the first portion being positioned between the base end of the electrically conductive conical surface and the second portion, the first portion being cylindrical and the second portion being frustoconical;

a ground plane plate having opposed first and second surfaces and including a peripheral edge, the vertex end of the electrically conductive conical surface being positioned adjacent to, and spaced apart from, the first surface of the ground plane plate;

at least one electrically conductive rod having opposed first and second ends, the first end of the at least one electrically conductive rod being secured to the second portion of the supplemental radiating element, the second end of the at least one electrically conductive rod being connected to the first surface of the ground plane plate at the peripheral edge;

a coaxial cable having a center conductor and an outer conductor, the center conductor being in electrical communication with the vertex end of the electrically conductive conical surface, and the outer conductor being in electrical communication with the ground plane plate; and a third radiating element mounted inside the electrically conductive conical surface, wherein the third radiating element is conical and includes a vertex end positioned adjacent the vertex end of the electrically conductive conical surface.

2. The omnidirectional ultra-wideband antenna as recited in claim 1, further comprising an annular, electrically non-conductive spacer disposed between the vertex end of the electrically conductive conical surface and the first surface of the ground plane plate.

3. The omnidirectional ultra-wideband antenna as recited in claim 2, wherein the first surface of the ground plane plate has a raised central portion, the annular, electrically non-conductive spacer being mounted thereon.

4. The omnidirectional ultra-wideband antenna as recited in claim 1, further comprising a cable fixing member having a hollow tubular portion and an annular flange, the cable fixing member securing said coaxial cable to the antenna concentrically below said ground plane plate.

5. An omnidirectional ultra-wideband antenna, comprising:

an electrically conductive conical surface having a vertex end and a base end;

a supplemental radiating element having a first portion and a second portion, the first portion extending from the base end of the electrically conductive conical surface, the first portion being positioned between the base end of the electrically conductive conical surface and the second portion, the first portion being frusto-conical and the second portion being cylindrical;

a ground plane plate having opposed first and second surfaces and including a peripheral edge, the vertex end of the electrically conductive conical surface being positioned adjacent to, and spaced apart from, the first surface of the ground plane plate;

at least one electrically conductive rod having opposed first and second ends, the first end of the at least one electrically conductive rod being secured to the second portion of the supplemental radiating element, the second end of the at least one electrically conductive rod being connected to the first surface of the ground plane plate at the peripheral edge;

a coaxial cable having a center conductor and an outer conductor, the center conductor being in electrical communication with the vertex end of the electrically conductive conical surface, and the outer conductor being in electrical communication with the ground plane plate; and a third radiating element mounted inside the electrically conductive conical surface, wherein the third radiating element is conical and includes a vertex end positioned adjacent the vertex end of the electrically conductive conical surface.

6. The omnidirectional ultra-wideband antenna as recited in claim 5, further comprising an annular, electrically non-conductive spacer disposed between the vertex end of the electrically conductive conical surface and the first surface of the ground plane plate.

7. The omnidirectional ultra-wideband antenna as recited in claim 6, wherein the first surface of the ground plane plate has a raised central portion, the annular, electrically non-conductive spacer being mounted thereon.

8. The omnidirectional ultra-wideband antenna as recited in claim 5, further comprising a cable fixing member having a hollow tubular portion and an annular flange, the cable fixing member securing said coaxial cable to the antenna concentrically below said ground plane plate.

* * * * *